US005897755A

United States Patent [19]

Star et al.

[11] Patent Number: 5,897,755

[45] Date of Patent: Apr. 27, 1999

[54] CATHODIC PROTECTION TEST STATION

[75] Inventors: Roger D. Star, St. Charles; Robert L. Dayton, Barrington, both of Ill.

[73] Assignee: Carsonite International Corporation, Early Branch, S.C.

[21] Appl. No.: 08/791,889

[22] Filed: Jan. 31, 1997

[51] Int. Cl.[6] ..... C23F 13/00

[52] U.S. Cl. ..... 204/196; 204/197; 205/724; 205/728; 205/733; 205/738

[58] Field of Search ..... 204/196, 197; 205/724–741

[56] References Cited

U.S. PATENT DOCUMENTS

| | | | |
|---|---|---|---|
| 3,037,920 | 6/1962 | Vixler | 204/197 |
| 3,326,791 | 6/1967 | Heuze | 204/196 |
| 3,477,930 | 11/1969 | Crites | 205/732 |
| 3,515,654 | 6/1970 | Bordalen et al. | 204/197 |
| 3,696,365 | 10/1972 | Ward | 204/196 |
| 4,080,565 | 3/1978 | Polak et al. | 324/71.1 |
| 4,356,444 | 10/1982 | Saenz, Jr. | 324/559 |
| 4,420,382 | 12/1983 | Riedl | 204/196 |
| 4,489,277 | 12/1984 | Goolsby | 204/196 |
| 4,515,669 | 5/1985 | Dimond et al. | 204/196 |
| 4,516,069 | 5/1985 | Schmanski | 324/71.1 |
| 4,639,677 | 1/1987 | Goolsby | 204/196 |
| 4,806,850 | 2/1989 | Saumade et al. | 205/775.5 |
| 5,139,634 | 8/1992 | Carpenter et al. | 204/196 |
| 5,178,822 | 1/1993 | Buford, III et al. | 204/404 |
| 5,268,632 | 12/1993 | Topping | 204/401 |
| 5,340,455 | 8/1994 | Kroon | 204/196 |
| 5,370,783 | 12/1994 | Carlson et al. | 204/196 |
| 5,415,745 | 5/1995 | Pultan et al. | 204/197 |
| 5,469,048 | 11/1995 | Donohue | 204/404 |
| 5,596,267 | 1/1997 | Lara et al. | 204/402 |

*Primary Examiner*—T. Tung
*Attorney, Agent, or Firm*—Thorpe, North & Western LLP

[57] ABSTRACT

A cathodic protection test station device has a terminal board integrally formed with a base plate. A removable housing locks onto the base plate and covers the terminal board and the base plate. A tab formed in the base plate extends into a recess formed in the housing defining a locking position. A tool may be inserted in an access slot formed in the housing to deflect the tab and remove the housing. A plurality of first wedge members are symmetrically disposed on a bottom surface of the base plate. The first wedge members have an inclined surface that slidably engages an inclined surface of a plurality of second wedge members. A bolt extends through the base plate and the first and second wedge members to a nut held in a non-rotating manner in the second wedge member. As the bolt rotates, the nut moves towards a head of the bolt and urges the first and second wedge members axially together. Because the wedge members engage each other with surfaces inclided with respect to an axis of the bolt, the second wedge member is displaced laterally or radially. As the second wedge member is displaced, a frictional contact surface formed on a perimeter of the second wedge member is forced against an inner surface of the tube for securing the test station to the tube.

21 Claims, 8 Drawing Sheets

CATHODIC PROTECTION TEST STATION

BACKGROUND OF THE INVENTION

1. Field of the Invention

The present invention relates to a cathodic protection test station. More particularly, the present invention relates to a cathodic protection test station having a removable housing which locks onto a base plate and also having displacable wedge members formed on the base plate for securing the test station to a tube.

2. Prior Art

Underground metallic structures, such as pipelines, are subject to corrosion. These structures are expensive and difficult to construct and perhaps more difficult and expensive to repair or replace due to corrosive failure. In addition, some structures serve vital functions where catastrophic failure of the structure may result in more harm than the mere loss of the structure itself. For example, a pipeline may contain toxic or volatile liquids and gases whose escape through a corrosion failure in the pipeline can endanger lives and the environment.

Corrosion is the dissolution of a metal into an aqueous environment. The metal atoms dissolve as ions. Electrochemical, or aqueous, corrosion occurs when a metal in an aqueous solution loses material to the solution. The variation in the metal ion concentrations in the solution causes an electrical current through the metal. The corroding metal acts as an anode and supplies electrons. This is known as an anodic reaction. Galvanic corrosion occurs when a more active metal is in contact with a more noble metal in an aqueous solution. The more active metal loses electrons to the more noble metal. The non-corroding metal acts as a cathode and receives electrons. This is known as a cathodic reaction.

Numerous methods have been developed to prevent corrosion. The most obvious method would be to coat the metallic structure with a non-corrosive coating, such as plastic or ceramic. Coating the structure, however, can be impracticable and expensive due to the enormous size of the structure.

A less obvious method for preventing corrosion, and the method which has garnered wide spread acceptance, involves manipulating the electro-chemical and galvanic phenomena involved in the corrosion itself; otherwise known as cathodic protection. Cathodic protection involves applying protective electrical currents from a more easily corroded metal such as magnesium or zinc. An electrical circuit is set up so that the magnesium or zinc corrodes as a sacrificial anode while the less active metal serves as the cathode and is not affected. This effect can also be obtained from an external source through a graphite or platinum anode receiving current from a rectifier, generator, or battery. Under both these conditions, current flows from the external anode through the soil to the structure. This current is of sufficient magnitude to afford cathodic protection to the underground structure.

The circuit that is established must be monitored to maintain optimum performance. This is achieved through the use of a variety of monitoring instruments. The instrument's primary function is to measure structure or pipe to soil potentials, i.e. the relative voltage in the circuit. If a major fluctuation occurs in this circuit, the structure may begin to corrode and an adjustment is necessary to compensate.

The underground location of the structure presents a special problem in that several feet of earth separate the structure from inspection. To monitor these voltage potentials, a test station is used. The test station is a passive device connected to the underground structure that offers a contact point in which the instrument can be connected to obtain the readings. The connection is usually made by means of a coated wire that is chemically welded to the structure. The wire is brought above ground through a conduit capped off with a condulet. The condulet or test station, will have connections to the wire.

The test station is positioned at any point of the structure where it is desired to monitor the voltage potential. In a pipeline application, numerous test stations are established along the length of the pipe.

The conduits may be metal or plastic, flexible or rigid. Although metal is widely used, it presents an electrical shock hazard and must be painted or coated to prevent corrosion. Plastic conduit is becoming more popular. Many test stations are actually a test station and conduit combination with the station and the conduit having a special fitting for joining them together. The problem with this configuration is that the station must be used with its mating conduit which adds cost and complexity to the installation of the station. In addition, the conduit is often of a nonstandard size and shape; making it more expensive that readily available, standard pipe, conduit and tubing.

An addition problem facing test stations is their location outdoors and in remote locations. The test stations are subject to adverse weather conditions and potential abuse by vandals.

Therefore, it would be advantageous to develop a cathodic test station capable of being used with standard pipe, conduit, and tubing. It would also be advantageous to develop a cathodic test station that is quickly and easily installed. Furthermore, it would be advantageous to develop a cathodic test station capable of resisting vandalism and adverse weather conditions.

OBJECTS AND SUMMARY OF THE INVENTION

It is an object of the present invention to provide a cathodic protection test station capable of installation on standard pipes, conduits, and tubes.

It is another object of the present invention to provide a cathodic protection test station that resists damage and removal by vandals.

It is yet another object of the present invention to provide a cathodic protection test station that is easily installed and removed.

It is a further object of the present invention to provide a cathodic protection test station with a locking cap.

It is a further object of the present invention to provide a cathodic protection test station capable of installation and removal with a single tool.

Still another object of the present invention is to provide a cathodic protection test station that will vent a pipe without introducing moisture into the conduit.

These and other objects and advantages of the present invention are realized in a cathodic protection test station device having wedge members to secure the device to a tube and a removable housing that locks onto a base plate. The test station has a terminal board secured to the base plate. The base plate has a plurality of first wedge members disposed symmetrically on its bottom surface. The first wedge members have an inclined lateral surface that slidable engages an inclined lateral surface of a plurality of second wedge members. The wedge members are held together by a bolt which passes through the base plate and the wedge members. A bore is formed in the first wedge members and base plate for maintaining the bolt in rigid alignment. A slot is formed in the second wedge members to allow movement of the second wedge members with respect to the bolt. A nut is attached to the end of the bolt and is disposed in a non-turning manner in the second wedge member. As the bolt is turned, the nut moves towards the head of the bolt, thus urging the two wedge members together. Because the wedge members engage each other with inclined surfaces, the second member is displaced laterally or radially. The second wedge member is displaced into a locking position where a friction contact surface of the second wedge member is forced against the inner surface of the tube. Because the extent to which the second wedge member is displaced may be varied, the test station may be used on a variety of different sized pipes, conduits, or tubes.

The test station also has a removable housing that fits over the terminal board and the base plate to protect them from adverse whether and vandalism. A tab formed in the base plate protrudes into a recess formed in the housing to lock the housing onto the base plate. An access slot is formed in the housing between a base perimeter of the housing and the recess so that a tool may be inserted through the slot and into the recess to displace the tab from the recess so that the housing may be removed. The access slot is positioned so that it is hidden under the housing and not readily observable.

In the preferred embodiment, the access slot and the head of the bolt are configured for use with a blade screw driver. Therefore, the test station may be installed and removed by a single tool.

Mounting tabs are formed around the perimeter of the base plate and extend downward over a top opening in the tube. The housing covers the tabs and the top opening to prevent moisture from entering the test station and the tube. A number of vent opening are formed in the base plate to release gases from the tube and the test station.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
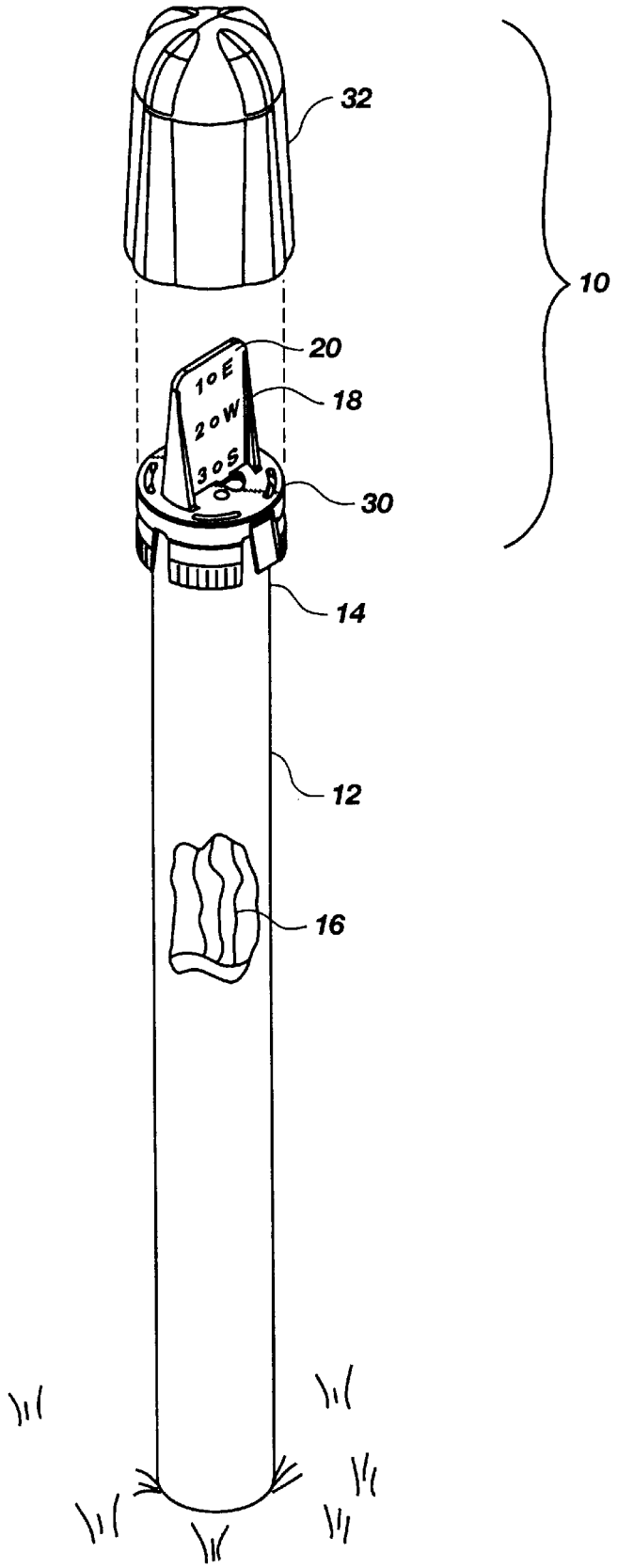
FIG. 1 is an elevational perspective view of a conduit incorporating a preferred embodiment of a cathodic protection test station of the present invention.

As illustrated in FIG. 1, a cathodic protection test station 10 of the present invention is shown installed on a pipe, conduit, or tube 12. The tube 12 protrudes from the ground and extends below the surface to underground structures such as utility lines or other subterranean materials (not shown). The tube 12 has a top opening 14 on which the test station 10 is installed. The tube 12 is a conduit through which electrical wires 16 extend between the test station 10 and the underground structure.

The test station 10 is a terminal at which electrical currents and potentials on underground metallic structures may be monitored. The wires 16 connect select parts of the underground structure to a terminal board 18 on the test station 10. To monitor the various electrical aspects of the underground structure, a user connects the terminals of a monitoring device, such as a multimeter, to contact points 20 on the terminal board 18. The advantage of the test station 10 is that it provides an access point to structures made inaccessible due to their location underground.

The test station 10 has a base plate 30 which is installed on the tube 12. The terminal board 18 is disposed on the base plate 30. A removable housing 32 locks onto the base plate 30 and protects the terminal board 18 and the opening to the underground structure created by the tube 12.

Although the present invention is described with particular reference to an embodiment involving the monitoring of electrical currents and potentials on metallic structures, it is of course understood that the test station of the present invention may be adapted to monitor non-electrical phenomena and for use on non-metallic structures, such as fiber optic cables.

Figure 2:
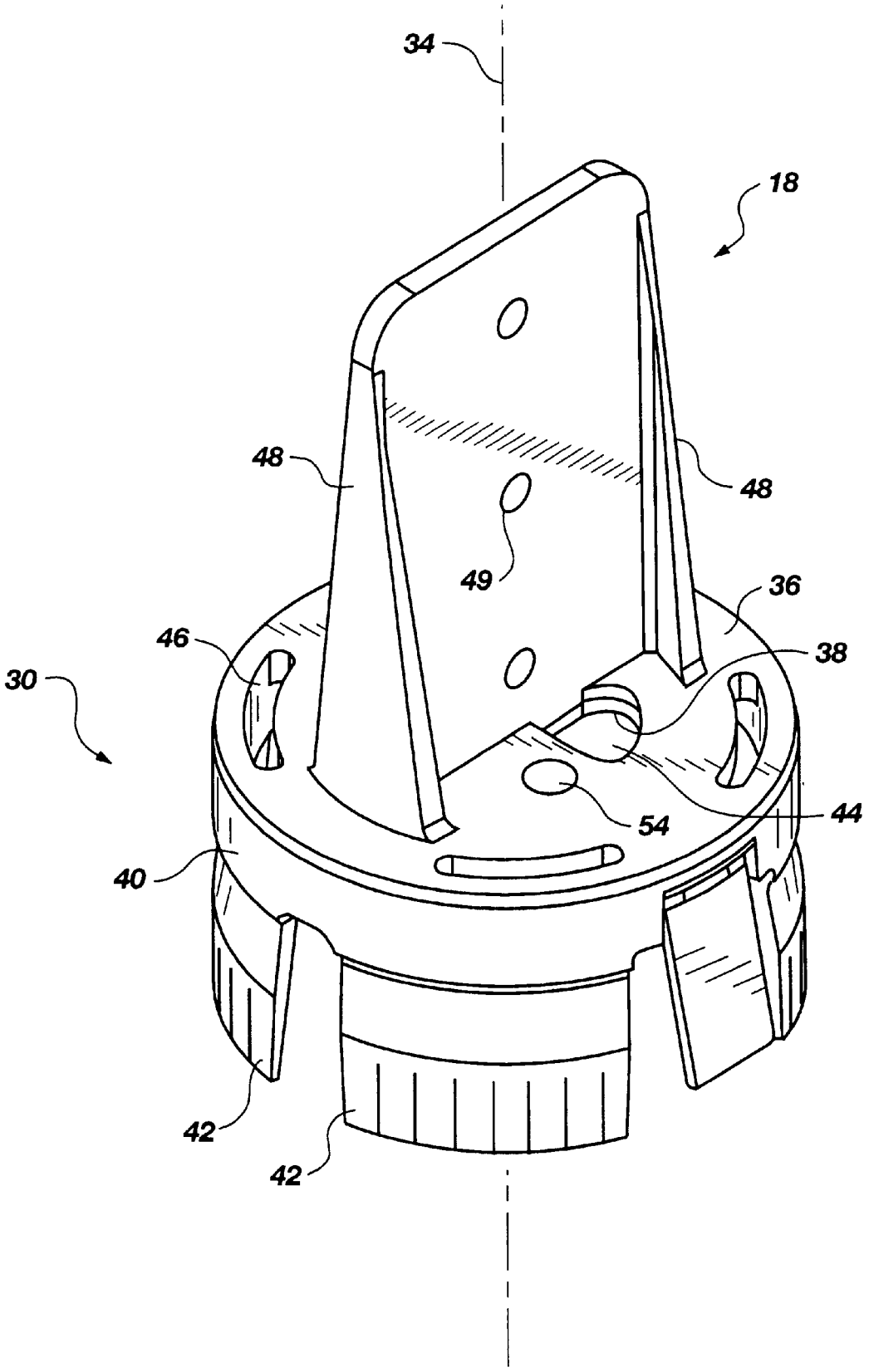
FIG. 2 is an elevational perspective view of a base plate and terminal board of a preferred embodiment of the cathodic protection test station of the present invention.
Figure 3:
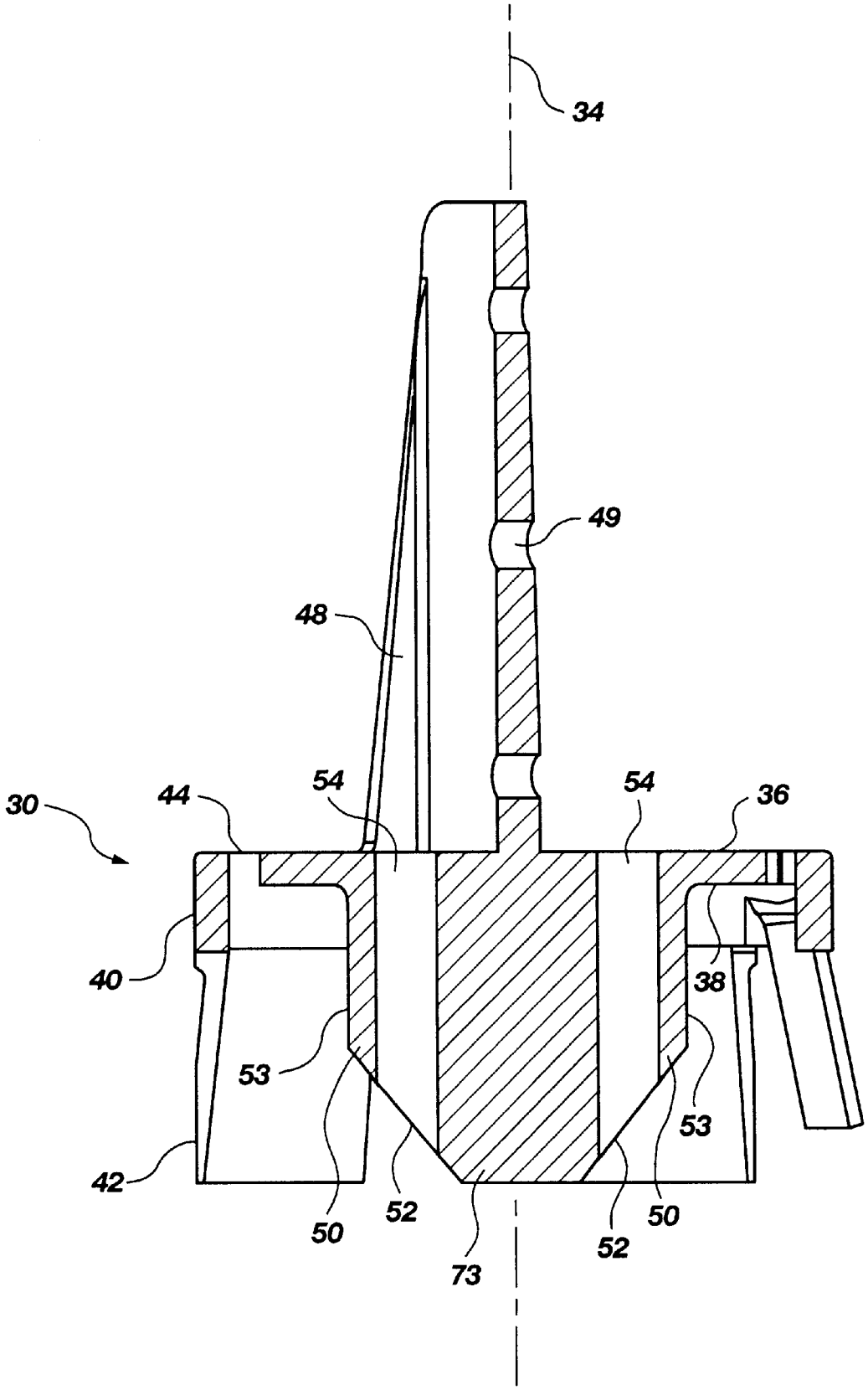
FIG. 3 is an elevational cross-section view of a base plate and terminal board of a preferred embodiment of the cathodic protection test station of the present invention taken along line 3—3 of FIG. 2.

As illustrated in FIGS. 2 and 3, the base plate 30 is a round plate formed about a vertical axis 34. The base plate 30 has a top surface 36 and a bottom surface 38. The terminal board 18 is disposed on the top surface 36 of the base plate 30 and is preferably formed integrally with the base plate 30. The base plate 30 also has a perimeter side wall 40 extending downward from the bottom surface 38 at the perimeter of the base plate 30. A plurality of mounting tabs 42 extend downward from the side wall 40. The tabs 42 also extend slightly radially or laterally with respect to the vertical axis 34.

Referring to FIG. 2, the terminal board 18 is disposed on the upper surface 36 of the base plate 30. In the preferred embodiment, the terminal board 18 is advantageously formed integrally with the base plate 30. The terminal board 18 has lateral flange members 48 extending upward from and coupled to the base plate 30. The lateral flange members 48 form triangular plates on opposing sides of the terminal board 18. The members 48 taper from a wide dimension where they couple to the base plate 30 to a narrow dimension near the top edge of the base plate 30. The flange members 48 provide strength to the connection of the terminal board 18 and base plate 30 and prevent the terminal board 18 from being inadvertently broken away from the base plate 30.

Contact bolts (not shown) are disposed in apertures 49 formed in the terminal board 18. The wires (not shown in FIG. 2) pass through the vent opening 44 and are secured to the contact bolts on the terminal board 18.

A plurality of vent openings 44 and 46 are formed in the base plate 30. The vent openings 44 and 46 allow gases to pass out of the tube 12 and the test station 10. Some of the vent openings 44 are positioned generally near the vertical axis 34 of the base plate 30 to allow gases to escape from the tube 12 into the test station 10. Other vent openings 46 are positioned near the perimeter of the base plate 30, at a distance from the vertical axis 34 greater than the radius of the tube 12, to allow gases to escape from the test station 10 to the atmosphere. Therefore, volatile, toxic, or pressurized gases do not accumulate in the test station 10 and pose possible dangers to a user of the station 10.

Referring to FIG. 3, a plurality of first wedge members 50 are disposed on the bottom surface 38 of the base plate 30. The wedge member 50 has a lateral face 52 oriented to face outward from the vertical axis 34 and inclined with respect to the bottom surface 38 of the base plate 30. The wedge member 50 also has an outer wall 53 parallel with and facing away from the vertical axis 34. A bore 54 is formed through the wedge member 50 and the base plate 30.

Figure 4:
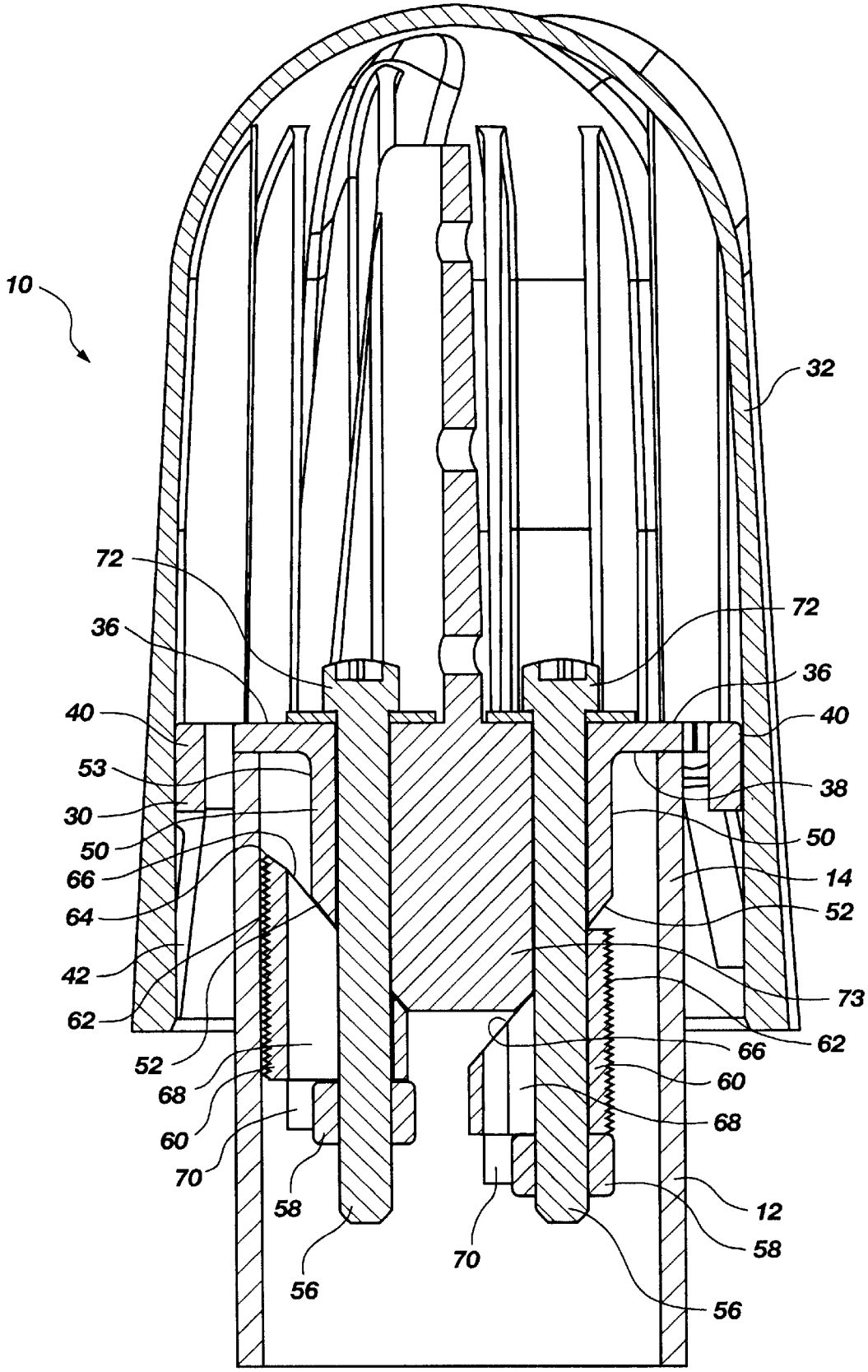
FIG. 4 is an elevational cross-section view of a conduit incorporating a preferred embodiment the cathodic protection test station of the present invention.

As illustrated in FIG. 4, when the test station 10 is installed, the bottom surface 38 of the base plate 30 sits on the top opening 14 of the tube 12. The tube 12 fits within the mounting tabs 42 and perimeter side wall 40 of the base plate 30.

A plurality of second wedge members 60 are movably coupled to the first wedge members 50 by the bolt 56 and a nut 58. The bolt 56 extends through the base plate 30 and the wedge members 50 and 60. The bolt 56 is disposed in the base plate 30 and wedge members 50 and 60 such that a head 72 of the bolt is positioned at the top surface 36 of the base plate 30.

Figure 5A:
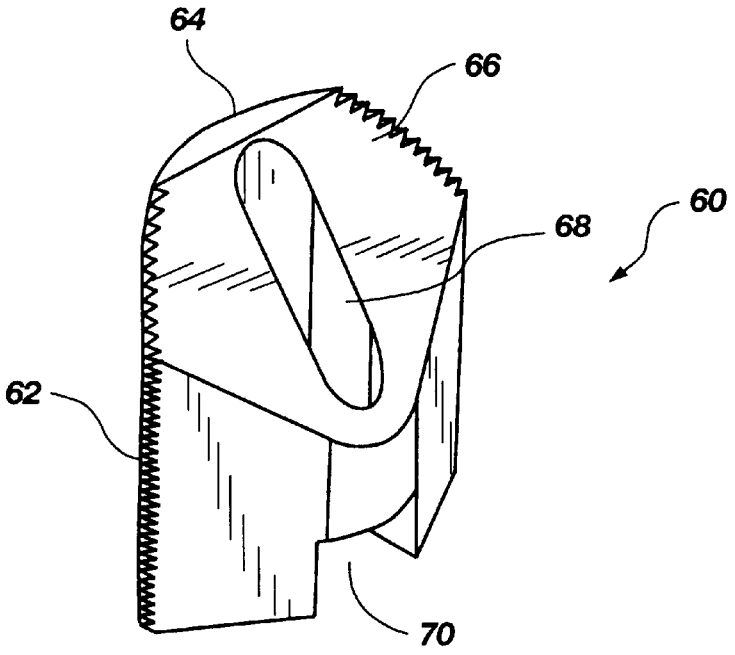
FIG. 5*a* is an elevational perspective view of a wedge member of a preferred embodiment of the cathodic protection test station of the present invention.
Figure 5B:
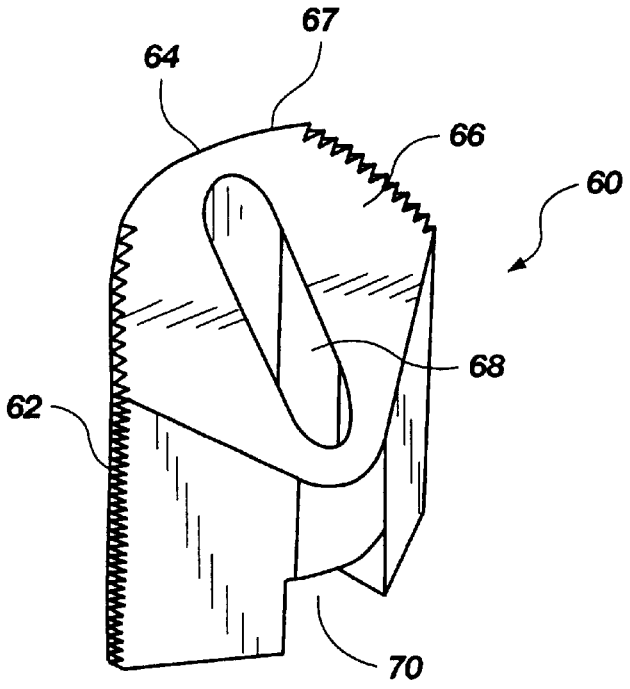
FIG. 5*b* is an elevational perspective view of a wedge member of an alternative embodiment of the cathodic protection test station of the present invention.

As illustrated in FIGS. 4 and 5*a*, the second wedge member 60 has an outer perimeter 64 that is arcuate or curved to generally conform to the inner surface of the tube 12. Because the test station 10 of the present invention is intended for use on tubes 12 of differing sizes, the outer perimeter 64 of the second wedge member 60 may not exactly match the curvature of the tube 12. The outer perimeter 64 has a frictional contact surface 62 for griping the inner surface of the tube 12 as the second wedge member 60 is laterally or radially displaced into contact with the inner surface of the tube, as shown on the left side of FIG. 4 and as discussed more fully below. The frictional contact surface 62 is oriented to be parallel with the vertical axis 34 and the wall of the tube 12. The second wedge member 60 may also have a pointed edge 67 for enhancing the grip of the second wedge member 60 on the inner surface of the tube 12, as shown in FIG. 5*b*.

The second wedge member 60 also has a lateral face 66 oriented to face inward to the vertical axis 34 and inclined with respect to the bottom surface 38 of the base plate 30. A slot 68 is formed through the wedge member 60 in which the bolt 56 is disposed. The slot 68 is sized and shaped to permit the wedge member 60 to move laterally or radially with respect to the bolt 56. Also formed in the second wedge member 60 is a groove 70 in which the nut 58 is disposed. The groove 70 is sized such that the nut 58 may slide within the groove 70 but may not rotate.

The wedge members 50 and 60 are coupled by the bolt 56 and nut 58 extending to opposing ends of the wedge members 50 and 60. The lateral faces 52 and 66 of the first and second wedge members 50 and 60 slidably engage each other. Because the nut 58 is prevented from turning by the groove 70, rotation of the bolt 56 causes the nut 58 to move along the length of the bolt 56. As the nut 58 moves towards the head 72, due to the bolt's rotation, the wedge members 50 and 60 are forced together. Because the wedge members 50 and 60 engage each other at lateral faces 52 and 66 which are inclined with respect to the axis of the bolt 56, the second wedge member 60 is displaced laterally or radially with respect to the first wedge member 50 and the axis 34, as shown on the left side of FIG. 4. The axis of the bolt 56 remains fixed or rigidly aligned as does the axis of the bore 54 of the first wedge member 50. The second wedge member 60 is permitted to move laterally or radially due to the slot 68.

Alteratively, as the bolt 56 is counter-rotated, the nut 58 moves away from the head 72. This released the force urging the wedge members 50 and 60 together and the frictional contact surface 62 of the second wedge member 60 ceases to contact the inner surface of the tube 12 so that the base plate 30 may be removed.

Figure 7:
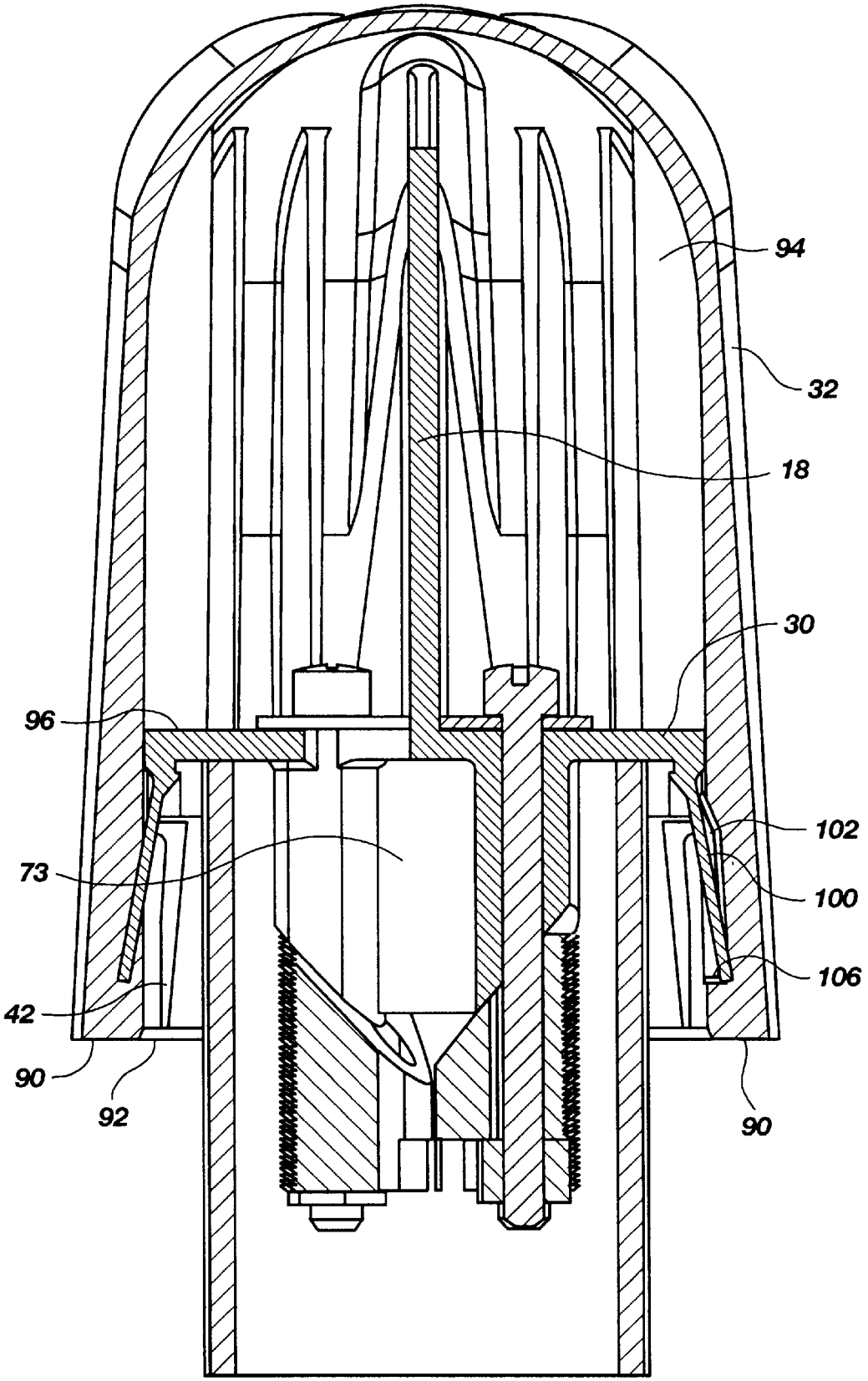
FIG. 7 is an elevational cross-section view of a conduit incorporating a preferred embodiment of the cathodic protection test station of the present invention.

Preferably, a plurality of first and second wedge members 50 and 60 are disposed symmetrically about the vertical axis 34 on the bottom surface 38 of the base plate 38. In the preferred embodiment of the present invention, a pair of wedge members 50 and 60 are symmetrically disposed on the base plate 30. A support bar 73 extends between the first wedge members 50 to maintain their rigid alignment, as shown in FIGS. 3, 4, and 7. Alternatively, any number of wedge members may be used.

The terminal board 18 is advantageously oriented vertically on the base plate 30 in a central position. This allows the heads 72 of the bolts 56 to be positioned on both sides of the terminal board 18, as shown in FIG. 4.

The base plate 30 is advantageously secured or locked onto the tube 12 by displacing the second wedge members 60 laterally or radially so that the frictional contact surface 62 securely engages the inner surface of the tube 12. The second wedge member's 60 displacement against the inner surface of the tube 12 defines a locking position.

The test station 10 is installed on a tube 12 by placing the base plate 30 on the top opening 14 with the wedge members 50 and 60 positioned on the inside of the tube 12 and by rotating the bolts 56 to displace the second wedge members 60 against the inner surface of the tube 12 and into a locking position. The test station 10 is advantageously held in place on the tube 12 by the frictional force created by the wedge members 50 and 60 forcing the contact surface 62 against the inner surface of the tube 12.

Figure 6A:
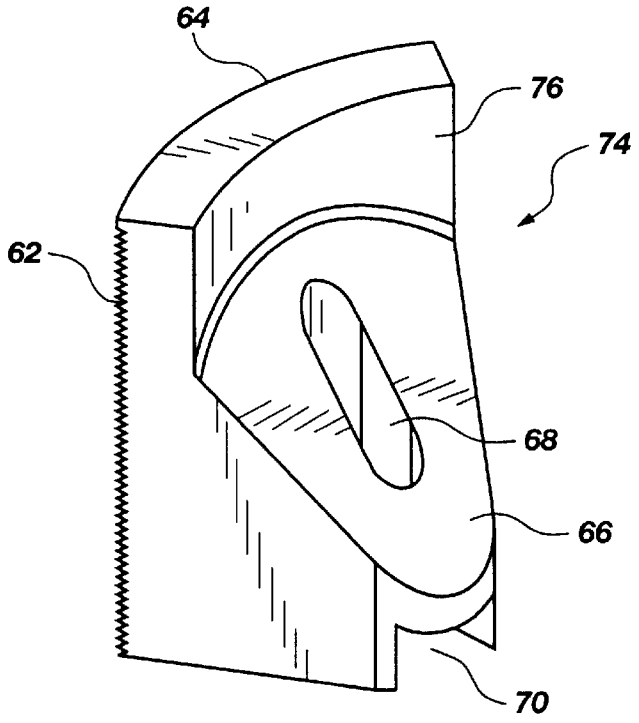
FIG. 6*a* is an elevational perspective view of a wedge member of an alternative embodiment of the cathodic protection test station of the present invention.
Figure 6B:
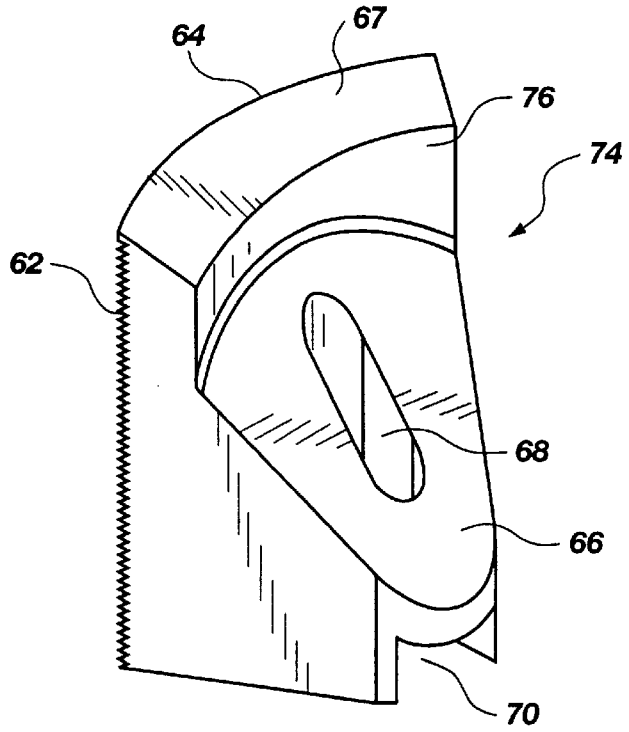
FIG. 6*b* is an elevational perspective view of a wedge member of an alternative embodiment of the cathodic protection test station of the present invention.

As illustrated in FIG. 6*a*, an alternative embodiment of a secondary wedge member 74 has a guide surface 76. The guide surface 76 contacts the outer wall 53 of the first wedge member 50 when the second wedge member 74 is in the non-locking position for aligning the second wedge member 74 with the vertical axis 34. Like the preferred embodiment of the secondary wedge member 60, the alternative embodiment of the secondary wedge member 74 has a lateral face 66 oriented to face inward to the vertical axis 34 and inclined with respect to the bottom surface 38 of the base plate 30. A slot 68 is formed through the wedge member 74 in which the bolt 56 is disposed. The slot 68 is sized and shaped to permit the wedge member 74 to move laterally or radially with respect to the bolt 56. Also formed in the second wedge member 74 is a groove 70 in which the nut 58 is disposed. The groove 70 is sized such that the nut 58 may slide within the groove 70 but may not rotate. The second wedge member 74 may also have a pointed edge 67 for enhancing the grip of the second wedge member 74 on the inner surface of the tube 12, as shown in FIG. 6*b*.

Although the preferred embodiment is shown having a pair of dynamic wedge members, it is of course understood that one set of wedge members may be integrally formed as a static member while the other set of wedge members remains dynamic to lock the test station to the tube. Dynamic wedge members are preferred, however, as this allows the test station to be centered over various sizes of tubes.

Figure 8:
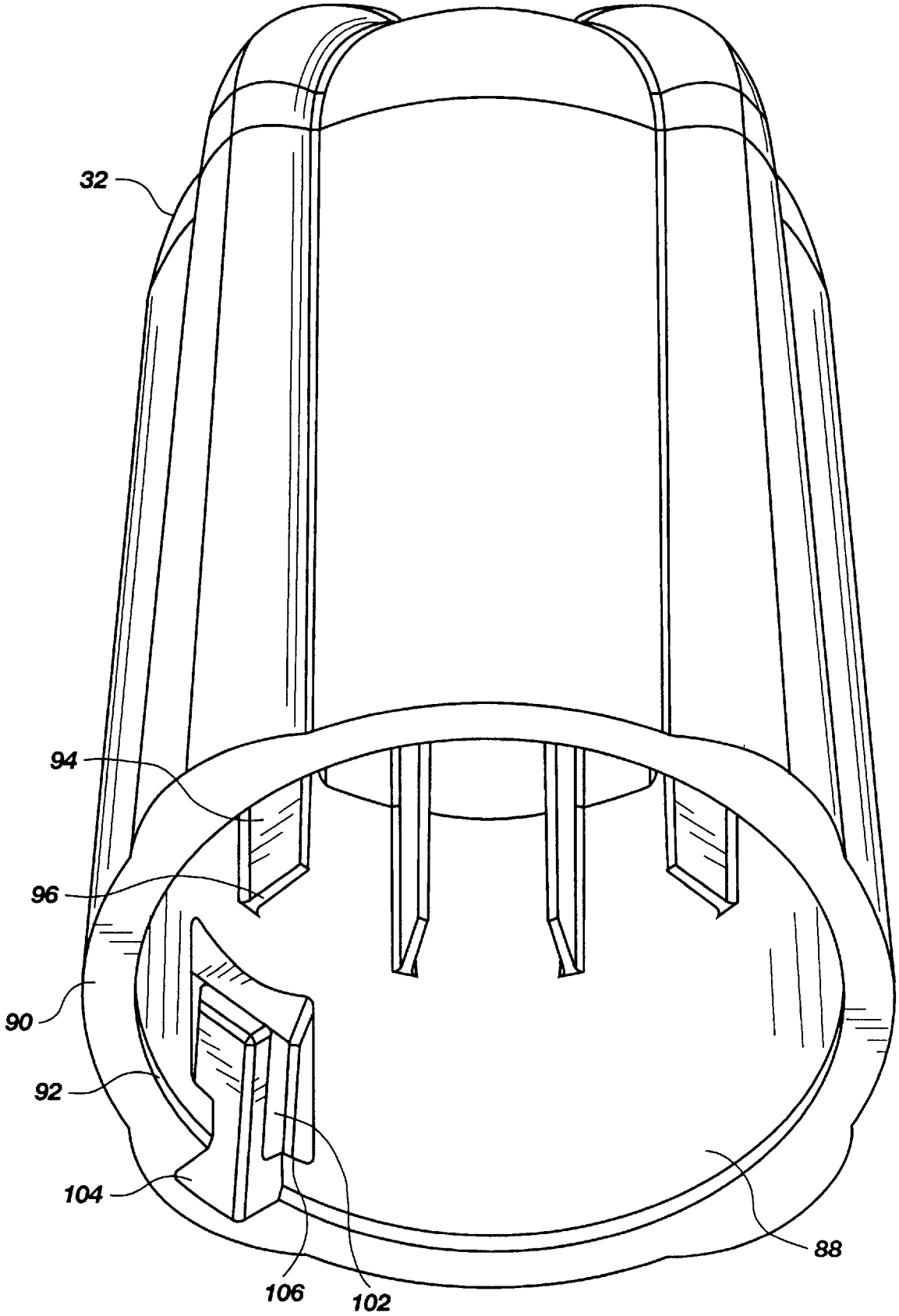
FIG. 8 is an elevational perspective view of a removable housing of a preferred embodiment of the cathodic protection test station of the present invention.

As illustrated in FIG. 7, a removable housing 32 covers the terminal board 18 and the base plate 30. Referring to FIG. 8, the housing 32 preferably forms a continuous cover for protecting the terminal board 18 from adverse weather. In the preferred embodiment, the housing 32 forms an elongated dome. The base of the housing 32 is left open to fit around the base plate 30 and defines an opening 88. A base perimeter 90 is defined by the lower edge of the housing 32 and an inner perimeter 92 is defined by the inside lower edge of the housing 32.

Ribs 94 are formed on the inside of the housing 32 to provide strength. The ribs 94 have a lower edge 96 that rests on the top surface 36 of the base plate 30 when the housing 32 is positioned on the base plate 30. The lower edge 96 of the ribs 94 acts as a stop to position the housing 32 in a locking position with respect to the base plate 30.

Referring to FIG. 7, the housing 32 is advantageously secured to the base plate 30 by a locking tab 100 formed in the plate 30 and projecting into a recess 102 formed in the housing 32. The locking tab 100 extends downward from the perimeter side wall 40 of the base plate 30. The tab 100 also extends slightly laterally or radially with respect to the vertical axis 34. The tab 100 is spring biased and projects into the recess 102 defining a locking position. The tab 100 may be deflected between the locking position and a non-locking position.

Referring to FIG. 8, the recess 102 is configured to receive the tab 100. A lip or edge 106 is formed at the bottom of the recess which the tab 100 engages to lock the housing 32 to the plate 30. An access channel 104 advantageously extends from the base perimeter 90 of the housing 32 to the recess 102. The access channel 104 is sized and shaped to permit a tool to be inserted through the channel 104 and into the recess 102 for deflecting the tab 100 to a non-locking position inward from the housing 32. Because the access channel 104 extends from the base perimeter 90 it is advantageously hidden from view, thus discouraging vandalism or unauthorized removal.

Preferably, the access channel 104 is sized and shaped to permit a blade screw driver (not shown) to be inserted and deflect the tab 100. In addition, the head 72 of the bolt 56 is preferably configured for use with a blade screw driver. The test station 10 may then be installed on and removed from the tube 12 with a single tool.

A plurality of locking tabs 100 may be formed on the base plate 30 to make securing the housing 32 easy and efficient. With a plurality of locking tabs 100, the housing 32 may be secured to the base plate 30 by placing the housing 32 completely over the base plate 30 and rotating the housing 32 until the locking tab 100 mates with the recess 102.

As illustrated in FIG. 4, the mounting tabs 42 extending from the base plate 30 downward so that the base plate 30 and mounting tabs 42 cover the top opening 14 of the tube 12. The housing 32 covers the base plate 30 and mounting tabs 42 and also advantageously covers the top opening 14 of the tube 12. This prevents moisture and contaminants from entering the test station 10 and the tube 12. The mounting tabs 42 also extend slightly laterally or radially so that the lower outside portion of the tab 42 contacts the inside perimeter 92 of the housing 32. Preferably, the mounting tabs 42 frictionally contact the housing 32 to resist removal of the housing 32.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. A cathodic protection test station device for insertion within a top opening of a tube for monitoring voltage potentials with respect to underground utility lines and other subterranean materials, said device comprising:

a base plate having a top surface, a bottom surface, a vertical axis and a perimeter side wall;

a terminal board coupled to the top surface of the base plate and including means for mounting terminal contacts for registering monitored voltage potentials;

a first wedge member coupled to the bottom side of the base plate and having a lateral face oriented to face outward from the vertical axis and being inclined with respect to the bottom surface of the base plate;

a second wedge member movably coupled to the first wedge member and having a frictional contact surface at an outer perimeter and a lateral face oriented to face inward toward the vertical axis and being inclined with respect to the bottom surface of the base plate, said lateral faces of the first and second wedge members being configured for slidable engagement; and locking means coupled to the second wedge member and the base plate for reversibly displacing the second wedge member laterally with respect to the first wedge member by pulling the lateral face of the second wedge member along the lateral face of the first wedge member to and from a locking position wherein a portion of the frictional contact surface extends beyond the first wedge member to enable frictional engagement of the second wedge member with an inner surface of the tube.

2. A device as defined in claim 1, further comprising:

a plurality of the first and the second wedge members with the lateral faces coupled with locking means for displacing the second wedge members laterally into the locking position.

3. A device as defined in claim 2, wherein the plurality of first and second wedge members are symmetrically disposed around the vertical axis of the base plate.

4. A device as defined in claim 2, wherein the terminal board is centrally disposed at the top surface of the base plate and the plurality of locking means are positioned on opposing sides of the terminal board.

5. A device as defined in claim 1, wherein the frictional contact surface of the second wedge member has a parallel orientation with the vertical axis.

6. A device as defined in claim 5, wherein the frictional contact surface includes gripping means for enhancing frictional resistance against movement of the second wedge member with respect to the inner surface of the tube.

7. A device as defined in claim 1, wherein the locking means comprises a threaded nut and bolt combination.

8. A device as defined in claim 7, wherein the bolt and first wedge member remain in rigid alignment.

9. A device as defined in claim 7, wherein the bolt is accessible at the top surface of the base plate.

10. A device as defined in claim 1, wherein the second wedge member includes a guide surface for aligning the second wedge member with the vertical axis.

11. A device as defined in claim 1, wherein the terminal board includes lateral flange members extending upward from and coupled to the base plate.

12. A device as defined in claim 11, wherein the lateral flange members form triangular plates at opposing sides of the terminal board, said plates tapering from a wide dimension coupled at the base plate to a narrow dimension near a top edge of the terminal board.

13. A device as defined in claim 1, further comprising:

a removable housing, said housing including an outer, continuous cover for shielding the terminal board from adverse weather; and locking means for retaining the housing in place.

14. A device as defined in claim 13, wherein the housing-retaining locking means is coupled to the base plate and is concealed within the cover of the housing.

15. A device as defined in claim 14, wherein the base plate further comprises a spring biased locking tab projecting into the removable housing.

16. A device as defined in claim 15, wherein the housing includes a recess configured to receive the locking tab, said housing including an access channel extending from a base perimeter of the housing to the recess to enable insertion of a deflecting means for deflecting the locking tab to a non-locking position inward from the housing.

17. A device as defined in claim 13, wherein the base plate further comprises perimeter tabs projecting downward around the perimeter of the base plate and being configured to engage an internal perimeter of the housing.

18. A device as defined in claim 17, wherein the perimeter tabs frictionally contact the housing to resist removal of the housing.

19. A device as defined in claim 1, wherein an angle formed by the lateral face of the first wedge member and an angle formed by the lateral face of the second wedge member are the same.

20. A device as defined in claim 1, further comprising:

a vent opening in the base plate to allow passage of gases from the tube to surrounding atmosphere.

21. A device as defined in claim 20, wherein the vent opening is positioned near the vertical axis of the base plate.

* * * * *